United States Patent [19]

Foster

[11] Patent Number: 4,648,641

[45] Date of Patent: Mar. 10, 1987

[54] SAFETY DEVICE

[75] Inventor: John K. Foster, Harwichport, Mass.

[73] Assignee: Packaging Industries Group, Inc., Hyannis, Mass.

[21] Appl. No.: 672,481

[22] Filed: Nov. 16, 1984

[51] Int. Cl.[4] ..... E05B 17/36

[52] U.S. Cl. ..... 292/264

[58] Field of Search ..... 242/1, 150, 252, 264, 242/341.15, 57, DIG. 46, 288, 179

[56] References Cited

U.S. PATENT DOCUMENTS

| | | | |
|---|---|---|---|
| 2,198,303 | 4/1940 | Chu | 292/DIG. 15 |
| 2,233,028 | 2/1941 | O'Connor | 292/19 |
| 3,993,336 | 11/1976 | Frost | 292/DIG. 46 |
| 4,105,231 | 8/1978 | Huyssen | 292/264 |

FOREIGN PATENT DOCUMENTS

| | | | |
|---|---|---|---|
| 1330696 | 9/1973 | United Kingdom | 292/179 |

*Primary Examiner*—Richard E. Moore

*Attorney, Agent, or Firm*—Berman, Aisenberg & Platt

[57] ABSTRACT

A safety device is described for use with a known safety chain. The safety device is a strip of foam-like plastic configured to fit in an elongate slot of the safety chain to prevent movement of the sliding member along the slot to thus prevent surreptitious entry. A display card includes a drawing of an actual safety chain and includes an actual slot which receives a safety device to thereby illustrate the use of the safety device in the actual safety chain.

2 Claims, 4 Drawing Figures

SAFETY DEVICE

FIELD OF THE INVENTION

This invention relates to the art of safety devices. In particular the invention is a device for improving the security associated with a known safety chain door lock. The invention also relates to an apparatus for the display of such a safety device.

BACKGROUND OF THE INVENTION

A common lock used on doors is a safety chain which allows a door to be partially opened so that a visitor may be viewed before being admitted, or so that articles, such as mail, may be passed through the partially-opened door. A safety chain includes a mounting block which is attached securely to the door jamb and receives one end of a chain, or a variant of this such as a strap or cable. Another element is securely mounted to the door and forms an elongate slot for receiving a second end of the chain. This element is oriented with the slot horizontal and spaced from the mounting block such that the distance from the mounting block to the remote end of the slot is substantially equal to the length of the chain. When the door is opened, the second end of the chain slides to the end of the slot nearest the mounting block, thus providing slack in the chain to permit the door to be slightly opened.

While the safety chain of the prior art has been generally accepted as providing good security, it has been shown not to be fail-safe. In fact, burglars have become quite adept at circumventing the prior art safety chain. For example, in a hotel it is common for keys to rooms to be freely available to those who want them. Keys are frequently dropped on the street and picked up by persons who then pass them to prospective burglars. Furthermore, the staff of a hotel is large enough that one who desires to have keys to rooms can easily obtain them. Once the burglar has a key to the room, the only impediment to entry is frequently the safety chain as described above.

One technique which has been developed for avoiding the safety chain is to open the door and engage the second end of the chain with a coat hanger. The door is then closed and the coat hanger manipulated to slide the second end along the slot so that the second end falls out of the end of the slot, thus freeing the safety chain. Another technique is to utilize a coat hanger or other implement while the door is open to engage a rubber band between the second end of the chain and a remote end of the slot element. Then, it is only necessary to close the door and allow the rubber band to pull the second end along the slot and allow it to fall free.

SUMMARY OF THE INVENTION

It will be appreciated that the above-mentioned techniques for gaining entry are easily accomplished and present a substantial safety problem. Applicant has developed a solution to this problem which is extremely inexpensive and easy to use.

In accordance with the invention, a safety device is configured to be slid into the channel which receives the second end of the chain, and this element prevents sliding the chain along the slot by simple manipulation with tools such as a coat hanger or a rubber band. The element is elongate, and in transverse cross section includes a small base portion and a somewhat triangular, outwardly extending portion so that it may be easily slid into a larger end of the slot and securely placed between the end of the safety chain and the remote end of the slot. The length of the safety device need not be exactly equal to the distance between the second end of the chain and the remote end of the slot. In fact it is preferable for it to be slightly longer.

The safety element is preferably made of a plastic, foam material so that it is extremely inexpensive to manufacture and has sufficient rigidity to resist the movement of the second end of the chain during attempted surreptitious entry.

Another aspect of the invention is to provide the safety devices in a strip containing a plurality of the devices in such a manner that a single one may be easily torn from the strip. A display card has a slot of the same dimension as a slot intended to receive the safety device, and the strip is displayed by allowing one of the safety devices to protrude through the slot while the remainder of the strip is hidden by the display card. The face of the display card includes a drawing of a prior-art safety chain, and the protruding element illustrates the use of the inventive safety device. The remainder of the display card can include instructions or advertising material.

An object of this invention is to provide a unique safety device.

A further object of this invention is to provide a flexible element adapted to be placed in a slot in a prior art safety chain to prevent surreptitious entry.

Yet another object of this invention is to provide a display card for holding a plurality of safety devices and illustrating the use of a single one of the safety devices.

DETAILED DESCRIPTION OF THE INVENTION

Figure 1:
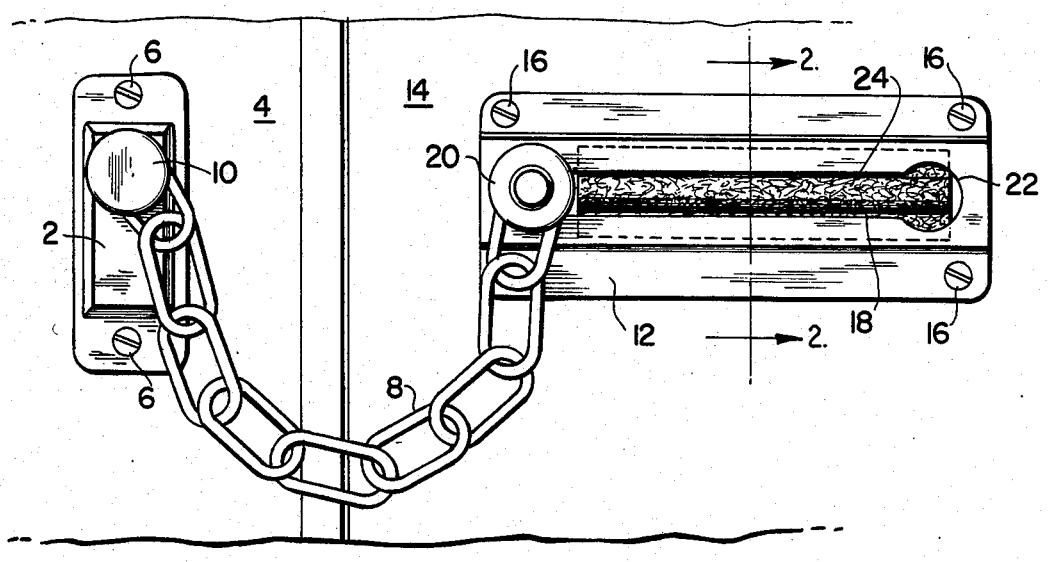
FIG. 1 is a front view of a safety chain showing the safety device of the invention is use.

FIG. 1 is a front view of a prior-art safety chain device attached to a door and jamb and illustrates the use of the safety device in accordance with the invention. A mounting block 2 is secured to a door jamb 4 by screws 6. A chain 8 has one end secured to the mounting block 2 by a stud 10. A slot-forming element 12 is attached to a door 14 by screws 16. The slot-forming element 12 includes a slot 18 which is elongate and is adapted to receive a sliding member 20 secured to a second end of chain 8. An end of slot 18 remote from mounting block 2 has an enlarged opening 22 to allow sliding member 20 to be inserted into and removed from the slot 18.

As known in the art, the safety chain described above is used by closing door 14 and placing sliding member 20 into slot 18 by passing a notched portion (not shown) of the sliding member 20 through the enlarged opening 22. The sliding member 20 is then placed in an intermediate position of the slot 18 until the door 14 is opened. When the door is opened, an edge of the door engages chain 8 and causes the sliding member 20 to move to the end of the slot 18 closest to the mounting block 6, which position is shown in FIG. 1. When the sliding member 20 is in the position shown in FIG. 1, the door can be opened only partially, and the chain 8 has a length which prevents a person from reaching through the opened door and moving sliding member 20 to the enlarged opening 22. On the other hand, burglars have discovered that the sliding member 20 may be removed from the slot by engaging it with a coat hanger, or other implement, while the door is opened and then by closing the door to provide slack in chain 18 while pushing the sliding member 20 toward enlarged opening 22 with the coat hanger. It is also possible to engage an elastic element, such as a rubber band, between the sliding member 20 and a raised portion of the slot-forming member 12. When the door is closed, the elastic member urges the sliding member 20 toward the enlarged opening 22.

In accordance with the invention, a safety device 24 is placed in the slot 18 after the sliding member 20 has been located in the slot. The safety device 24 preferably substantially fills the slot 18 between the sliding member 20 and the enlarged opening 22, thereby preventing movement of the sliding member 20 along the slot. If desired, an end of the safety device 24 may protrude from opening 22. It will be appreciated that this in no way interferes with the normal operation of the safety chain whereby the door may be opened to view a visitor or the like.

Figure 2:
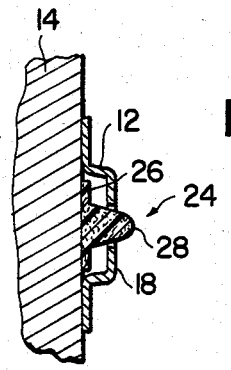
FIG. 2 is a cross section taken along line 2—2 of FIG. 1.

FIG. 2 is a cross section taken along line 2—2 of FIG. 1 and shows the safety device 24 in more detail. The safety device 24 includes a somewhat flat base portion 26 and a somewhat triangularly-shaped portion 28. The base portion 26 preferably lies flat against the door 14 while the triangularly-shaped portion 28 extends outwardly through the slot 18.

The safety device 24 is preferably made of a known foam-like plastic material to result in an extremely inexpensive article. Furthermore, the foam material is somewhat flexible to permit easy installation through enlarged opening 22, and yet sufficiently rigid to prevent movement of sliding member 20 along the slot. The base 26 and the triangular-shape of the outwardly extending portion 28 also contribute to the rigidity of the foam-like plastic in the longitudinal direction.

In operation, one need merely insert the safety device 24 into the slot 18 through the opening 22 to assume a position as shown in FIG. 1. This will prevent surreptitious entry by preventing movement of sliding member 20 along the slot 18. Furthermore, in the case of fire, an occupant of the room can easily grasp the safety device 24 and remove it from the slot while at the same time moving sliding member 20 along the slot to allow the door to be fully opened.

Figure 3:
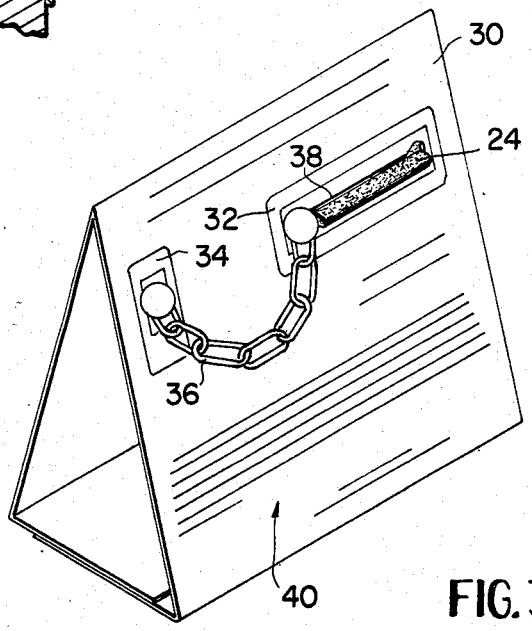
FIG. 3 is a perspective of a display card illustrating use of the invention.

FIG. 3 shows a preferred manner of displaying the safety device of the invention. A display card 30 includes a drawing 32 of member 12, a drawing 34 of mounting block 2 and a drawing 36 of chain 8. The card 30 includes a slot 38 which is substantially the same size as slot 18, and a safety device 24 is installed in the slot 38. The display card also includes advertising indicia, or the like, 40.

Figure 4:
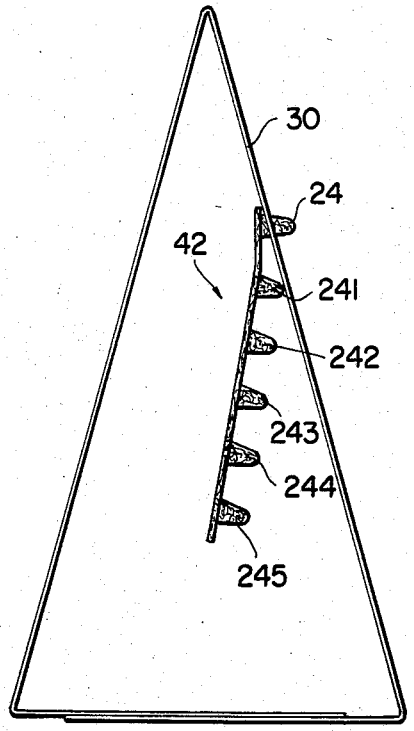
FIG. 4 is a side view of the display card shown in FIG. 3.

FIG. 4 is a side view of the display card shown in FIG. 3 and shows the preferred manner of displaying and distributing the safety devices 24 in accordance with the invention. A strip 42 includes a plurality of safety devices 24, 241, 242, 243, 244, and 245. The strip 42 is manufactured easily by known molding processes, and the display card 30 is supplied with a strip 42 having any desired number of safety devices. The safety device 24 is displayed and its use is simultaneously illustrated because the slot 38 is in the same location with respect to drawing 32 as slot 18 is with respect to slot-forming member 12. The remainder of the safety devices 241 through 245 are hidden by the display card 30 so that only a single safety device 24 is seen from the front of the card. When it is desired to use a safety device 24, one merely removes strip 42 from the display card, tears the safety device from the strip, and places it in the slot 18.

It will be appreciated that an extremely useful safety device and display card have been described. The safety device is inexpensive to manufacture and yet provides a marked improvement in the safety of the known safety chain device. A display card provides a unique method of displaying a plurality of articles and simultaneously illustrating the use of one of the articles. Modifications of the invention within the scope of the appended claims will be apparent to one of ordinary skill in the art.

What is claimed is:

1. In a door chain lock of the type having a chain with a first part attached to a door frame and a second part, and a channel means having an elongate slot for receiving said second part, the improvement comprising blocking means in said slot wherein when said second part is at one end of said slot said blocking means prevents movement of said second part along said slot, and wherein said blocking means comprises a removable element having a length approximately equal to the distance between said second part and a second end of said slot when said second part is at said one end, and wherein said blocking means further comprises a base portion and an outwardly-extending portion tapered away from said base portion in transverse cross-section, said base and tapered portions extending along substantially the entire said length.

2. Apparatus according to claim 1 wherein said blocking means is of flexible plastic.

* * * * *